United States Patent [19]

Consaul et al.

[11] 4,085,702

[45] Apr. 25, 1978

[54] OFFSET PREVENTION DURING FIXING

[75] Inventors: James William Consaul, East Rochester; Thomas Arthur Jadwin, Rochester, both of N.Y.

[73] Assignee: Eastman Kodak Company, Rochester, N.Y.

[21] Appl. No.: 671,875

[22] Filed: Mar. 29, 1976

[51] Int. Cl.[2] ..... G03G 15/20

[52] U.S. Cl. ..... 118/60; 118/259; 239/314; 239/318; 427/22

[58] Field of Search ..... 427/22, 425; 118/258, 118/259, 60, 203; 432/60, 75, 228; 217/216; 239/314, 318

[56] References Cited

U.S. PATENT DOCUMENTS

| | | | |
|---|---|---|---|
| 955,418 | 4/1910 | Mikorey | 239/314 |
| 3,301,699 | 1/1967 | Mozzi | 118/259 X |
| 3,356,072 | 2/1967 | Sloan | 118/259 X |
| 3,780,950 | 12/1973 | Brennan | 239/314 X |
| 3,934,547 | 1/1976 | Jelfo et al. | 118/60 |
| 3,941,085 | 3/1976 | Hattler et al. | 118/60 |
| 3,964,431 | 6/1976 | Namiki | 118/60 |
| 3,976,814 | 8/1976 | Murphy | 118/60 X |

FOREIGN PATENT DOCUMENTS

| | | | |
|---|---|---|---|
| 368,067 | 3/1932 | United Kingdom | 239/318 |

*Primary Examiner*—James Kee Chi
*Attorney, Agent, or Firm*—Milton S. Sales

[57] ABSTRACT

A contact fixing device for fixing electrostatic marking particles carried on a support material is disclosed. The device includes a rotatably mounted fixing roller, a container for a supply of offset preventing material and applicator means for spraying the offset preventing material directly onto the peripheral surface of the fixing roller. Control means are provided for activating the applicator means after a predetermined period of operation of the fixing roller.

6 Claims, 4 Drawing Figures

OFFSET PREVENTION DURING FIXING

BACKGROUND OF THE INVENTION

1. Field of the Invention

The present invention relates generally to devices for distributing offset preventing material to the peripheral surface of a fixing roller, and more particularly to apparatus for applying such material without direct contact to the roller by intermediate feed devices.

2. Description of the Prior Art

In the process of xerography, a xerographic plate comprising a layer of photoconductive insulating material on a conductive backing is given a uniform electric charge over its surface and is then exposed to the subject matter to be reproduced, usually by conventional projection techniques. This exposure discharges the plate areas in accordance with the radiation intensity that reaches them, and thereby creates an electrostatic latent image on or in the photoconductive layer. Development of the latent image is effected with an electrostatically charged, finely divided developing material or electrostatic marking particles (toner) which is brought into surface contact with the photoconductive layer and is held thereon electrostatically in a pattern corresponding to the electrostatic latent image. Thereafter, the developed toner image is usually transferred to the surface of a support material such as paper, to which it may be fused by heat or vapor fixing techniques. During such fusing, the individual toner particles soften and become tacky so that they readily adhere to the surface of the support material.

It is common practice in the art to apply heat for fusing the toner image to paper by bringing the toner image into direct contact with a hot surface, such as the peripheral surface of a heated roller such as for example the roller disclosed in U.S. Pat. No. 3,437,032, which issued Apr. 8, 1969 to A. T. Manghirmalani et al. However, since the toner image is tackified by heat, part of the image carried by the support material will stick to the surface of the heated roller so that, as a second sheet is brought into contact with that surface, the tackified image partially removed from the first sheet will partly transfer to the second sheet and, at the same time, part of the tackified image from the second sheet will itself adhere to the heated roller. Also, during revolution of rollers 12 and 14 (FIG. 1) without paper therebetween, toner on the fusing roller may transfer to the pressure roller. These conditions are commonly referred to in the printing art as "set off" or "offset," the latter term being preferred and used throughout the remainder of the present specification.

The offset of toner onto the heated roller has led to the use of other types of fixing devices, such as coiled radiant element heaters with reflectors. However, such devices have the disadvantages of dissipating a large quantity of heat into the machine enclosure, insufficiently heating the toner image and presenting a safety hazard because of the exposed radiant element. Therefore, improved methods for direct contact fusing devices which will rapidly fuse toner images without causing the toner particles to adhere to the fusing roller while in a tackified state have been developed.

One such method involves direct fusing devices in which the fusing roller is coated with an abhesive material such as tetrafluoroethylene resin sold under the trademark Teflon by the DuPont Corporation or silicone rubber or elastomer. Such rollers may be provided with an offset preventing film such as a silicone oil film to prevent toner offset. Teflon, silicone rubber and silicone oil have physical characteristics such that they form a "release" surface which is highly repellent to tacky substances.

The silicone oil film may be applied to the fusing roller by various techniques. For instance, U.S. Pat. No. 3,132,047, which issued May 5, 1964 to W. G. Van Dorn, discloses the use of an applicator roller to transfer oil from a pan directly to the surface of a fusing roller. In U.S. Pat. No. 3,256,002, which issued June 14, 1966 to F. W. Hudson, a wick is provided between the applicator roller and the fusing roller surface, and in British Pat. No. 1,399,740 published July 2, 1975, an oil pump was substituted for the applicator roller of the Hudson patent. In these and every other prior art method known to us for applying offset preventing material to fusing rollers, wicks and/or applicator rollers contact the fusing roller. Such contact tends to abrade the adhesive surface of the fusing roller resulting in premature failure of the roller.

Further, prior art wicking apparatus require low viscosity offset preventing liquids. For instance, Dow-Corning's FS 1265 fluorosilicone oil, having a viscosity of 1,000 centistokes, has been wicked onto a thermally conductive silicone elastomer. Although such an oil functions well for prevention of offset, it is expensive, it adversely affects the physical properties of silicone elastomers, it deteriorates the bond between the silicone elastomers and aluminum roller cores and its degradation products are toxic.

Dimethyl silicone oil such as Dow-Corning's DC 200 is a logical replacement for fluorosilicone oil, but at viscosities similar to FS 1265, it excessively swells silicone rubbers. We have found that higher viscosity silicone oils have considerably less effect on silicone elastomers, but wicking such high viscosity oils (i.e., oils having viscosities of at least 10,000 centistokes) presents additional problems. That is, wicks may occasionally be dismembered upon start-up or may clog after long use of high viscosity oils. Besides having less effect on the physical properties of silicone elastomers. silicone oils with viscosities up to about 100,000 centistokes provide better release characteristics for a given quantity of oil and greater persistence on the fusing and pressure rollers.

SUMMARY OF THE INVENTION

Accordingly, it is an object of the present invention to provide improved apparatus for applying offset preventing materials to fixing rollers wherein less wear is caused to the fixing roller because there is no contact with the roller by an applicator.

It is another object of the present invention to provide an improved apparatus for applying such materials to fixing rollers wherein very high viscosity oils may readily be applied.

These and other objects and advantages of our invention are achieved by applying offset preventing material to fixing rollers in a controlled manner without physically contacting the fixing roller. In a preferred embodiment, this is accomplished by use of a spraying device to apply the offset preventing material, thereby avoiding direct contact of the applicator with the fixing roller and also avoiding the aforementioned problems encountered with the clogging of wicks.

The invention, and its objects and advantages, will become more apparent in the detailed description of the preferred embodiments presented below.

BRIEF DESCRIPTION OF THE DRAWINGS

In the detailed description of the preferred embodiments of the invention below, reference is made to the accompanying drawings, in which.

DETAILED DESCRIPTION OF THE PREFERRED EMBODIMENTS

Although the present invention relates to an improved roll fixing device which may have general application, it is particularly useful in the field of xerography and has an important application in the fixing of resinous powder images produced by electrophotography onto sheets of paper and the like to which the powder images have been transferred after they have been formed by deposition of powder on an electrostatic latent image. Therefore, for convenience of illustration, the invention is described with reference to its use as a heat fuser for xerographic powder images. However, it is to be understood that it may be employed with equal facility in pressure (no heat) fixing devices, in electrography and/or in other fields. As used herein, the term "fixing" is meant to refer to heat fusing as well as to pressure fixing. Because xerographic devices are well known, the present description will be directed in particular to elements forming part of, or cooperating more directly with, apparatus in accordance with the present invention. It is to be understood that elements not specifically shown or described may take various forms well known to those skilled in the art.

First Embodiment

Figure 1:
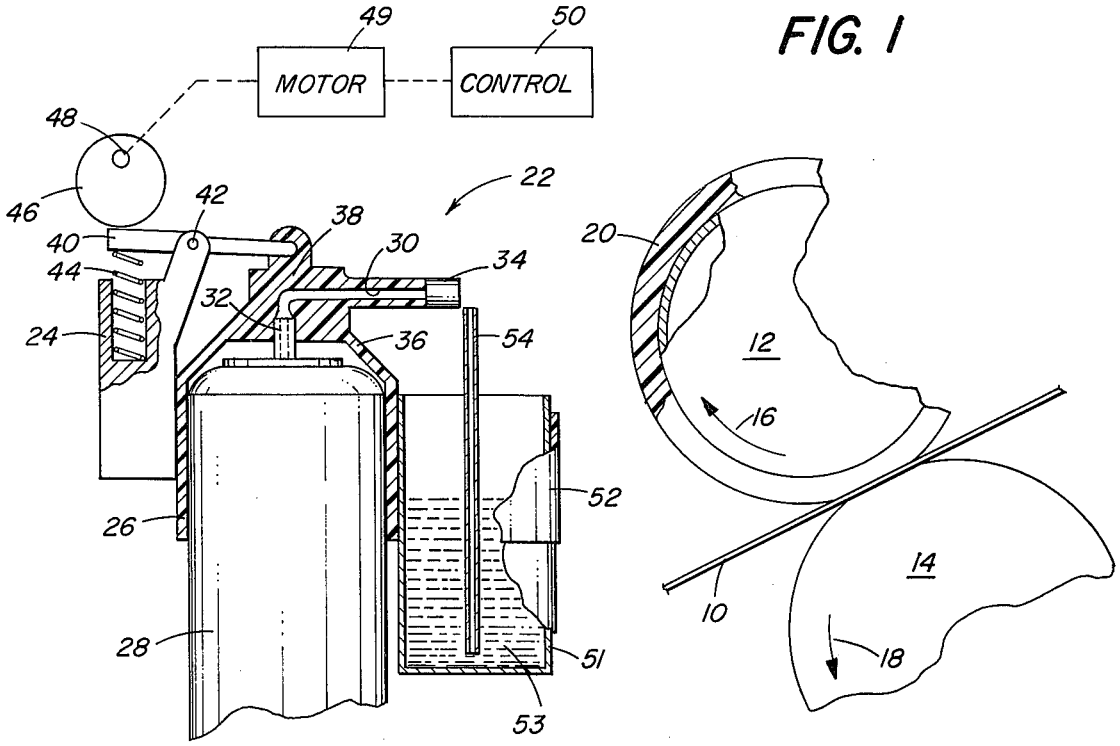
FIG. 1 is a side elevational view, partially in section, of a portion of a fixing device constructed in accordance with a preferred embodiment of the present invention.

Referring to FIG. 1, we have shown an exemplary embodiment of an offset preventing material applicator in accordance with the present invention. Direct contact fixing of a powder image on a support material is achieved for forwarding a sheet 10 of such support material, bearing the powder image, between a heated fixing roller 12 and a heated or unheated pressure roller 14 as is conventional in the art. The various constructions of rollers 12 and 14, means for rotatably supporting them and means for driving them in the directions of arrows 16 and 18, respectively, are known in the art and reference is made to the various patent literature set forth hereinbefore for suitable constructions which may be used for these purposes.

As a sheet of support material 10 is advanced between rollers 12 and 14, the powder image on the support material will contact the peripheral heated surface surface of roller 12, whereby the powder image becomes tackified and, in this tackified condition, the power will tend to offset onto this roller. Such offset may be partially prevented by coating roller 12 with a tetrafluorethylene resin (Teflon) or with silicon rubber 20. However, to prevent even this limited tendency of toner offset onto the heated contact surface of roller 12, a thin film of offset preventing material such as silicone oil, is commonly applied to the peripheral surfce of roller 12; and we have found that such such offset preventing materials may be applied to fixing rollers in a controlled manner without physically contacting the roller, such as by spray application.

Positioned adjacent fixing roller 12 is a spray applicator 22 consisting of a bracket 24 which carries a rubber receptacle 26 into which a standard, commercially available aersol can 28 is receivable. A duct 30 in the upper portion of receptacle 26 receives the activator button 32 of aerosol can 28 and provides communication between button 32 (which is the output of can 28) and a nozzle 34. The annular side wall 36 of receptacle 26 is highly flexible so that depression of a portion 38 of the receptacle will in turn depress button 32, causing the contents of can 28 to be released through duct 30 and nozzle 34.

A lever 40, pivotally mounted at 42 to bracket 24 is urged by a spring 44 in a clockwise direction as viewed in FIG. 1, tending to depress portion 38 of receptacle 26. The lever is normally held against such movement by a disc 46 eccentrically mounted on a shaft 48 for rotation therewith upon actuation of a motor 49 by a control 50. p A cup 51 is held adjacent can 28 such as for example by a rubber strap 52 molded as an integral unit with receptacle 26. Cup 51 is supplied with an offset preventing material 53 to be supplied to fixing roller 12. An aspirator tube 54 extends into the contents of cup 51 and has its upper end just beneath the path of propellant emitted from nozzle 34 so that offset preventing material 53 will be drawn from cup 51 at a predetermined rate when activator button 32 is depressed, and will mix with the propellant from can 28 for application to the peripheral surface of fixing roller 12.

We have hereinbefore set forth the advantages of high viscosity silicone oils as offset preventing materials, as well as many problems associated with the use of high viscosity oils which would arise in prior art application techniques. The present invention provides a very efficient way to dispense high viscosity oils by spraying techniques by using emulsions having a water-like viscosity even though the silicone oil viscosity itself may actually be greater than 100,000 centistokes. The water which is evaporated from such emulsions when sprayed onto heated fusing roller 12 might be expected to present a cause for concern since steam can adversely affect silicone rubber. However, the amount of water released, assuming a rather high application rate of 1 gram of fluid every 100 copies produced, would in fact be less than 5 percent of that ordinarily released by 100 sheets of paper during fusing. The actual emulsion viscosity is not critical as long as the emulsion can be sprayed with the apparatus used. Enough oil should be in the emulsion to prevent offset without undue water evaporation.

EXAMPLE 1

We have stated that one of the advantages of the present invention is the ability to apply high viscosity oils to a fusing roller, resulting in greater persistence on the roller. We have conducted experiments, the results of which appear to confirm this belief. During such experiments, we also looked for traces of oil on the copy paper since it is important that such not be noticeable.

Initial experiments were conducted with a hard cylindrical poly(tetrafluoroethylene)-coated steel pressure roller and a resilient fixing roller which had previously been used to fuse 30,000 copies. The fixing roller and an aluminum core with an external silicone rubber surface comprised of 50 mils of Emerson-Cuming Eccosil 4952 silicone rubber. The fixing roller was internally heated with an infrared lamp to 400° F. Surface speed of the roller fuser was approximately 10 inches per second, and the pressure was approximately 15 pounds per linear inch.

The following three silicon oil emulsions were tested as release agents by applying them to the fixing roller with an aerosol can at an application rate of approximately 1 gram per spray:

| Emulsion | Source | Approximate 0.1 Viscosity (CS) |
|---|---|---|
| SM-62 | General Electric | 300 |
| SM-2040 | General Electric | 10,000 |
| HV-490 | Dow Corning | 100,000 |

Several sheets of International Xerographic 20 pound bond paper with a toner stripe were passed through the experimental apparatus with no release emulsion applied to the fusing roller. Offset was immediate and severe.

After cleaning the apparatus, the three emulsions were each tested at least three times by spraying the fixing roller for approximately one second and then running copy with a toner stripe through the fuser until offset occurred. The first copy through the fuser after spraying was carefully checked to be certain it did not contain an objectionable, i.e., noticeable, amount of oil. With SM-62 fluid, offsetting occurred after approximately 300 11-inch copies, while both SM-2040 and HV-490 emulsions were consistently able to run at least 500 copies before offset occurred.

EXAMPLE 2

Another series of tests were run using a similar fusing roller which had previously fused 80,000 copies. During the tests, pressure was approximately 15 pounds per linear inch, the roller speed was increased to 11.5 inches per second and two fusing temperatures, 380° and 400° F, were tested. HV-490 emulsion was chosen to be sprayed onto the roller because of its favorable persistence characteristic demonstrated in the previously described test.

Again, the fixing roller severely offset when no release agent was applied. Several runs at 380° and 400° F were carried out and the number of acceptable copies counted until the slightest detectable amount of offsetting occurred. As with the previous test, the first copy after spraying was examined to be certain it did not have noticeable oil. The results were as follows, the number of copies indicating legal size (14 inch) paper run in the long direction:

| Run No. | Roller Temperature (F°) | No. of Copies to offset |
|---|---|---|
| 1 | 380 | 300 |
| 2 | 380 | 270 |
| 3 | 380 | 350 |
| 4 | 380 | 200 |
| 5 | 400 | 100 |
| 6 | 400 | 83 |
| 7 | 400 | 84 |
| 8 | 400 | 84 |

-continued

| Run No. | Roller Temperature (F°) | No. of Copies to offset |
|---|---|---|
| 9 | 400 | 110 |

The last run (number 9) was continued beyond the point of initial offset until the offsetting was equivalent to that experienced before the emulsion was sprayed onto the roller; 370 copies passed through the fuser before this condition was reached, indicating that some release properties are maintained long after the first slight offsetting is noticed. It is believed that the poorer results obtained in the second example, compared to the first, even taking into account the difference in paper length, resulted from the use of a worn fusing roller.

Second Embodiment

Figure 2:
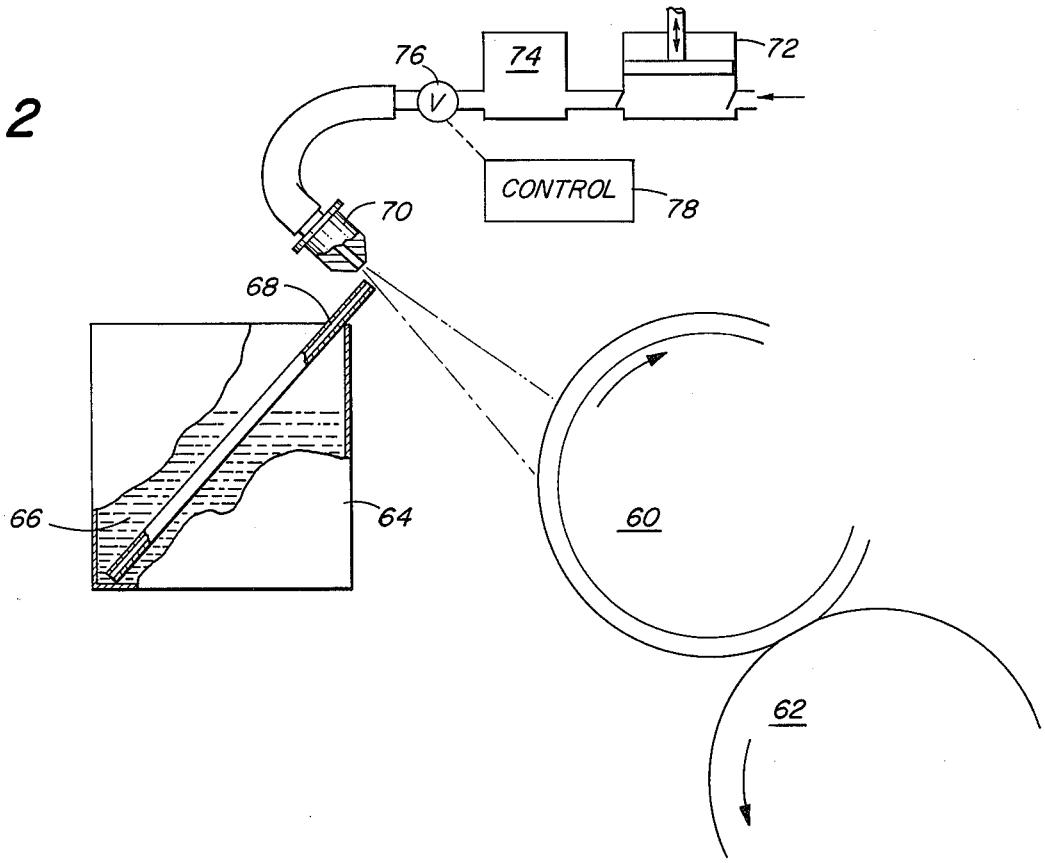
FIG. 2 is a view similar to FIG. 1 of another preferred embodiment of the present invention.

Referring to FIG. 2, we have schematically shown apparatus in accordance with a second illustrative embodiment of our invention. Fixing roller 60 and pressure roller 62 may be the same as those previously described with respect to the embodiment illustrated in FIG. 1.

A cup 64 positioned adjacent fixing roller 60 is supplied with an offset preventing material 66 to be applied to the fixing roller surface. An aspirator tube 68 extends into the liquid contents of cup 64 and has its upper end just beneath the path of propellant emitted from a nozzle 70 so that offset preventing material 66 will be drawn from cup 64 through tube 68.

Propellant for nozzle 70 may be derived from a pneumatic pump 72 and stored in an air pressure accumulator 74 until a valve 76 is opened by a control 78. While we estimated that the amount of spray needed for each application in the examples given was roughly one gram, this, as well as the number of copies which can be satisfactorily produced per spray, should be empirically determined for each apparatus and method of use. Once determined, controls 50 (FIG. 1) and 78 (FIG. 2) can be preprogrammed to regulate the amount and frequency of release material applied to the fixing rollers. For instance, the controllers may be set to operate after a predetermined period of fixing roller use in response to, say, a copy counter, a roller revolution counter, timing signals emitted anywhere in the apparatus, etc.

Figure 3:
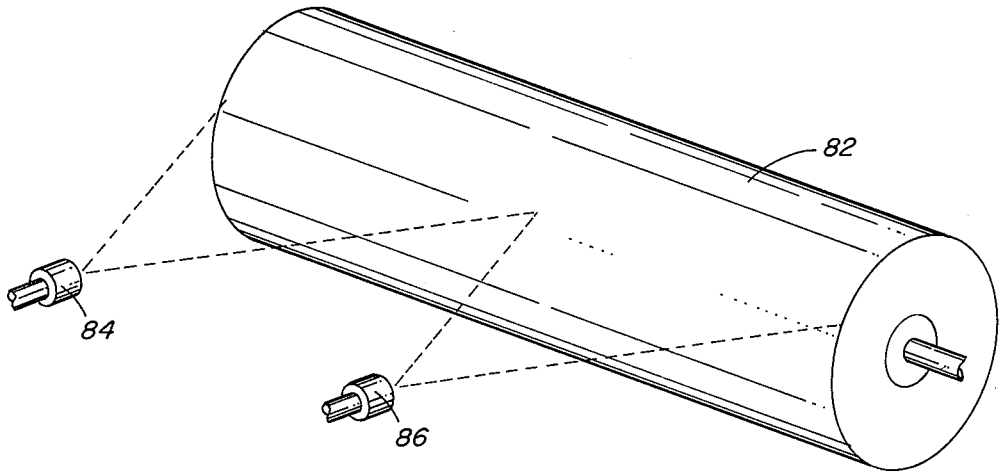
FIG. 3 is a partial view of one form of use of the fixing devices of either FIG. 1 or FIG. 2.

The nozzles of spray applicators would preferably spray in a line pattern along the length of the fixing rollers. As shown in FIG. 3, for long rollers 82, a plurality of nozzles 84 and 86 could be positioned along the roller. The multiple nozzles could share propellant and/or release material sources, or would have independent sources.

Figure 4:
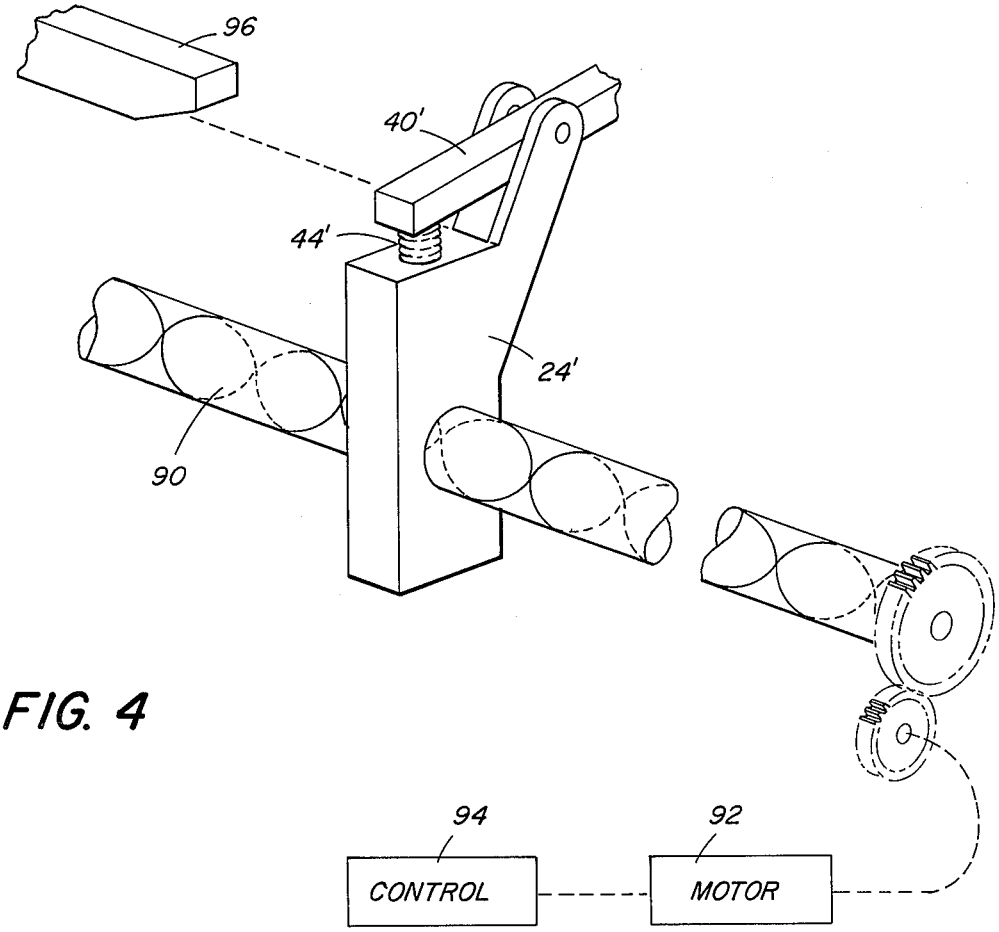
FIG. 4 is a partial view of a modification of the fixing device of FIG. 1.

Alternatively, full coverage of a long fixing roller may be accomplished by a traversing device such as, for example, as shown in FIG. 4, wherein a bracket 24' is similar to bracket 24 of the FIG. 1 embodiment except that it is mounted for movement along a reversing helical gear 90 driven by a motor 92 upon command of control 94.

As in FIG. 1, rotation of lever 40' by spring 44' releases propellant. The reader is referred to FIG. 1 and the portion of this specification relating thereto for details of the apparatus not shown in FIG. 4. Normally, bracket 24' rests at the left-most end of helical gear 90 with the end of lever 40' held depressed against the force of spring 44 by a cam block 96. Upon activation of motor 92 by control 94, helical gear 90 begins turning to move block 24' to the right. As soon as lever 40' clears cam block 96, release material begins to be sprayed on the fixing roller. When block 24' reaches the right-hand end of gear 90, its direction is reversed and it travels to the left until cam block 96 again depresses lever 40', turning off the spray.

Throughout this specification, we have used silicone oil as an example of offset preventing material which may be sprayed onto fixing rollers in accordance with out invention. However, it will be recognized that other materials, say, powders such as Teflon powder prepared in latex form, could be used as offset preventing materials.

The invention has been described in detail with particular reference to preferred embodiments thereof, but it will be understood that variations and modifications can be effected within the spirit and scope of the invention.

We claim:

1. In a device for contact fixing electrostatic marking particles carried on a support material, said fixing device being of the type including a member having a fixing surface and a container for a supply of offset preventing material, the improvement comprising applicator means for distributing offset preventing material having a viscosity of at least approximately 10,000 centistokes from said container onto the fixing surface of the member without physically contacting the fixing surface of the member by said applicator means.

2. In a device for contact fixing electrostatic marking particles carried on a support material, said fixing device being of the type including a member having a fixing surface and a container for a supply of offset preventing material, the improvement comprising applicator means for spraying offset preventing material having a viscosity of at least approximately 10,000 centistokes from said container onto the fixing surface of the member.

3. The improvement as defined in claim 2 wherein said applicator means comprises:

means for directing a stream of propellant gas toward the member; and an aspirator device associated with the container and said gas stream directing means for injecting said offset preventing material, which has been prepared as an emulsion of water-like viscosity, into said gas stream.

4. The improvement as defined in claim 2 wherein said applicator means is selectively operable and further comprising control means for operating said applicator means after a predetermined period of fixing device use, whereby a predetermined quantity of offset preventing material is sprayed onto the fixing surface in accordance with the frequency of operation of the fixing device.

5. The improvement as defined in claim 2 wherein said applicator means comprises a plurality of spray devices spaced axially along the fixing surface.

6. The improvement as defined in claim 2 wherein said applicator means comprises a spray device movable axially alonge the fixing surface.

* * * * *